US008529146B2

(12) United States Patent
Yoshioka

(10) Patent No.: US 8,529,146 B2
(45) Date of Patent: Sep. 10, 2013

(54) PRINTER

(75) Inventor: Yukio Yoshioka, Tokyo (JP)

(73) Assignee: NEC Infrontia Corporation, Kanagawa (JP)

( * ) Notice: Subject to any disclaimer, the term of this patent is extended or adjusted under 35 U.S.C. 154(b) by 657 days.

(21) Appl. No.: 12/182,966

(22) Filed: Jul. 30, 2008

(65) Prior Publication Data

US 2009/0032637 A1 Feb. 5, 2009

(30) Foreign Application Priority Data

Jul. 31, 2007 (JP) ..... 2007-198782

(51) Int. Cl.
*B41J 11/70* (2006.01)
*B65H 35/06* (2006.01)
*G07G 1/00* (2006.01)

(52) U.S. Cl.
USPC ..... 400/691; 400/621; 400/693

(58) Field of Classification Search
USPC ..... 400/621, 621.1, 691, 693; 242/562; 83/98, 167; 235/2, 4, 7 R
See application file for complete search history.

(56) References Cited

U.S. PATENT DOCUMENTS

| | | | | |
|---|---|---|---|---|
| 6,672,504 | B1 * | 1/2004 | Ueda et al. | 234/50 |
| 2002/0021930 | A1 * | 2/2002 | Yamada | 400/621 |
| 2007/0051219 | A1 * | 3/2007 | Tamura et al. | 83/214 |
| 2009/0097879 | A1 * | 4/2009 | Nagashima et al. | 399/120 |

FOREIGN PATENT DOCUMENTS

| | | | |
|---|---|---|---|
| JP | 4-141399 | A | 5/1992 |
| JP | 5-104494 | A | 4/1993 |
| JP | 06242519 | * | 9/1994 |
| JP | 11-263526 | * | 9/1999 |
| JP | 2001-310512 | * | 11/2001 |
| JP | 2001310512 | A | 11/2001 |
| JP | 2004-142192 | A | 5/2004 |

* cited by examiner

*Primary Examiner* — Ren Yan
*Assistant Examiner* — Marissa Ferguson Samreth
(74) *Attorney, Agent, or Firm* — Sughrue Mion, PLLC

(57) ABSTRACT

A printer including a lower frame on which roll paper is loaded, a cutter section mounted above the lower frame for cutting the roll paper on which printing is made, and a cover that allows a front of the lower frame to be opened and closed is provided. A slope portion for causing paper dust or a slip of paper, which falls from the cutter section, to slip down toward the front of the lower frame is provided at a portion of the lower frame below the cutter section. The cover is provided with a pocket portion for receiving the paper dust or the slip of paper slipping down on the slope, and the pocket portion is adjacent to the lowest portion of the slope portion when the cover is closed.

7 Claims, 2 Drawing Sheets

PRINTER

This application is based upon and claims the benefit of priority from Japanese Patent Application No. 2007-198782, filed on Jul. 31, 2007, the disclosure of which is incorporated herein in its entirety by reference.

FIELD OF THE INVENTION

The present invention relates to a printer used for an electronic device such as a POS (Point Of Sales system) terminal.

BACKGROUND OF THE INVENTION

A small-sized printer, which is used for an electronic device such as a POS terminal and carries out printing on roll paper, is provided with a cutter section for cutting the roll paper after carrying out printing at an appropriate position (or length).

In this type of cutter section, a fixed blade and a movable blade are disposed so as to provide a paper conveying path therebetween. This type of cutter section is configured so as to put roll paper between them and cut the roll paper positioned in the paper conveying path by moving the movable blade toward the fixed blade. Normally, a movable cutter unit provided with the movable blade and the fixed blade are respectively fixed to a lower frame and an upper frame of the printer, which are combined so as to be openable and closable with each other, in consideration to easiness for setting of roll paper to the printer.

Now, in this type of cutter section, paper dust or a slip of paper is generated when roll paper is cut. On the other hand, electric parts such as an electronic circuit board are mounted in the lower frame of the printer. In the case where paper dust or a slip of paper is deposited on the electric parts, it causes an incorrect operation, fire or the like. For this reason, it is required a scheme to collect such paper dust or a slip of paper.

As the related art for collecting paper dust or a slip of paper generated from a cutter section, there is a device including: a path downwardly continuing from a roll paper cutting position of a cutter section; a paper-slip receiving portion provided at a lower end of the path and having a table-like form, the paper-slip receiving portion being in communication with the outside via a paper-slip collecting port; and a cover that openably blocks the paper-slip collecting port, as disclosed in Japanese Patent Application Publication No. 2001-310512, for example.

SUMMARY OF THE INVENTION

In the cutter section of the related art, the paper-slip receiving portion is fixedly provided inside a housing of the printer, and the paper-slip collecting port is normally blocked (or closed) by means of the cover. For this reason, in order to collect the paper dust or the slip of paper deposited on the paper-slip receiving portion, the cover must first be opened, a small-sized dustpan or the like must be set to the paper-slip receiving portion, and a small-sized broom or the like must then be swept out of the paper-slip receiving portion. Therefore, there has been a problem that such a cleaning operation is complicated. In addition, there is a possibility to spill the paper dust or the slip of paper when sweeping it out of the paper-slip receiving portion.

Accordingly, it is an object of the present invention to provide a printer capable of collecting paper dust or a slip of paper generated by a cutter section easily and surely without spilling it.

According to the present invention, it can be obtained a printer including a lower frame on which roll paper is loaded, a cutter section mounted above the lower frame for cutting the roll paper on which printing is made, and a cover that allows a front of the lower frame to be opened and closed, a slope portion for causing paper dust or a slip of paper to slip down toward the front of the lower frame being provided at a portion of the lower frame below the cutter section, the paper dust or the slip of paper falling from the cutter section, wherein the cover is provided with a pocket portion for receiving the paper dust or the slip of paper slipping down on the slope, and the pocket portion is adjacent to the lowest portion of the slope portion when the cover is closed.

Further, according to the present invention, it can be obtained an electronic device including the printer as described above.

According to the present invention, since paper dust or a slip of paper generated by a cutter section is deposited in a pocket portion of a cover, the paper dust or the slip of paper can be collected easily and surely without spilling it only by carrying out an operation to open the cover.

DESCRIPTION OF THE EXEMPLARY EMBODIMENTS

A printer according to the present invention includes a lower frame in which roll paper is loaded, a cutter section mounted above a lower frame for cutting the roll paper on which printing is made, and a cover that allows a front of the lower frame to be opened and closed. A slope portion for causing paper dust or a slip of paper, which falls from the cutter section, to slip down toward the front of the lower frame is provided at a portion of the lower frame below the cutter section.

Then, the cover is provided with a pocket portion for receiving the paper dust or the slip of paper slipping down on the slope. The pocket portion is adjacent to the lowest portion of the slope portion when the cover is closed.

In this regard, the cover may be one that is rotatively opened in a direction to which a rear end of the pocket portion is lifted when the vicinity of a front surface of a lower end of the cover is used as a fulcrum.

Further, the cover may be a single part made of a resin.

The cutter section may include a fixed blade and a movable cutter unit disposed opposite to a lower side of the fixed blade. In this case, the cover covers at least the front surface of the movable cutter unit.

Further, the lower frame is provided with a portion continuing over a front surface of the lower frame from the slope portion.

Moreover, the present printer may further include a platen for sending out the roll paper loaded on the lower frame toward the cutter section. In this case, a shielding member for preventing the paper dust or the slip of paper to be scattered toward a loaded portion of the roll paper may be provided between the slope portion and the platen. This shielding member may be composed of an electricity removing brush that removes static electricity charged on the platen by sliding on a peripheral surface of the platen.

Furthermore, the cover may be provided with a paper discharge path that supports and discharges the roll paper cut by the cutter section, and a hole portion that causes paper dust, a slip of paper and water arriving from the outside of the cover to fall to the outside of the cover is formed in the paper discharge path.

EXAMPLE

Hereinafter, an example of the present invention will be described in detail with reference to the drawings.

A printer according to the present example is a printer integrated into an electronic device such as a POS terminal or used as a stand-alone device in connection with an electronic device such as a POS terminal, for example.

Figure 1:
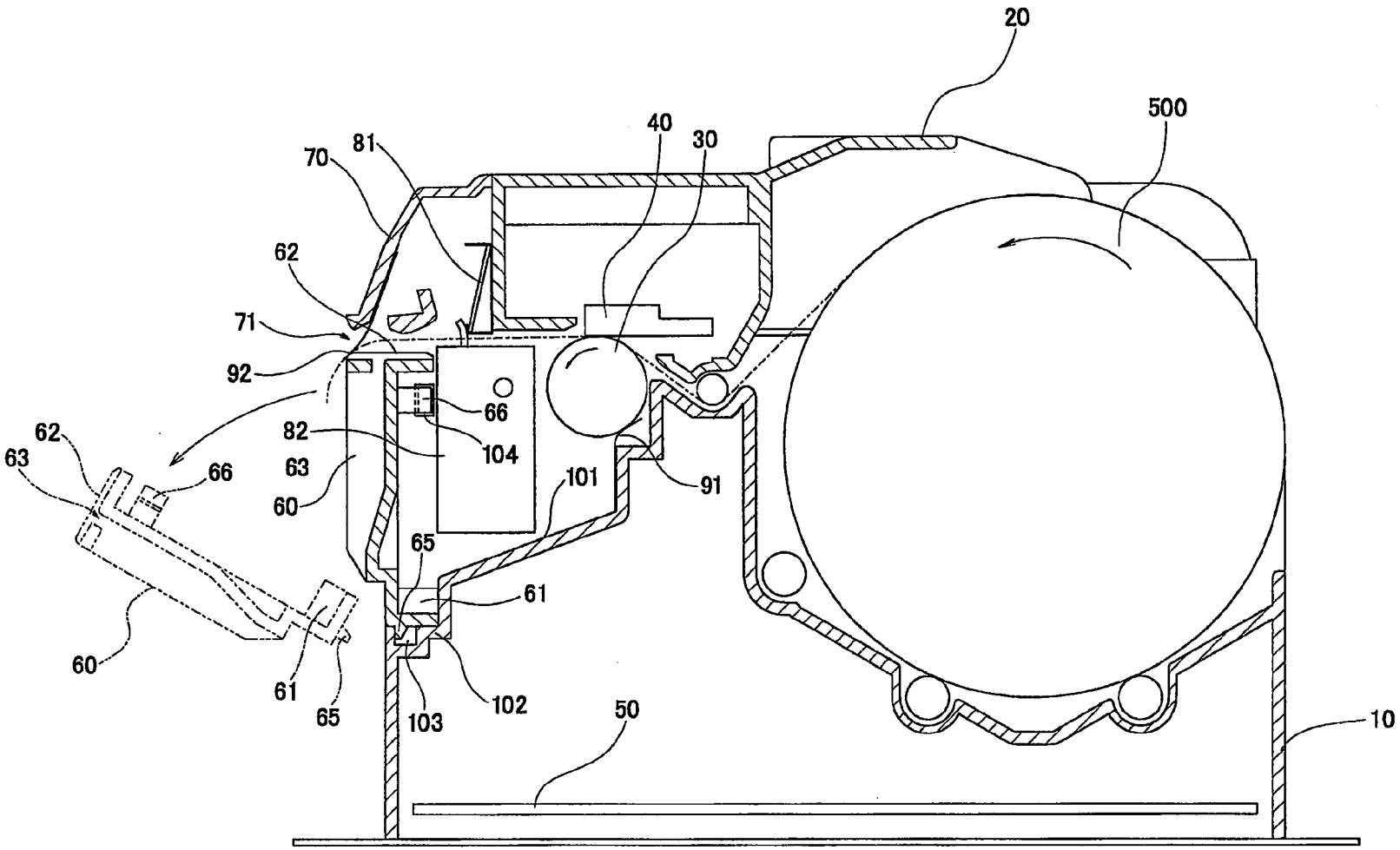
FIG. 1 is a sectional view showing a basic configuration of a printer according to an example of the present invention.
Figure 2A:
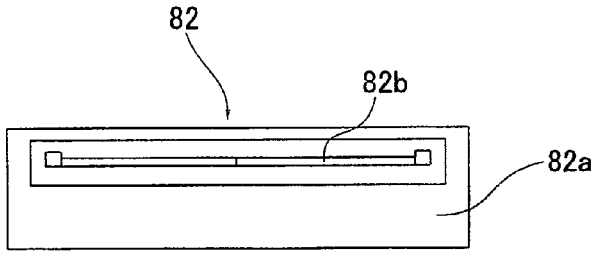
FIG. 2A is a plan view of a movable cutter unit in the printer shown in FIG. 1.
Figure 2E:
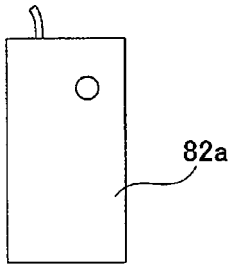
FIG. 2E is a left side view of the movable cutter unit in the printer shown in FIG. 1.
Figure 2B:
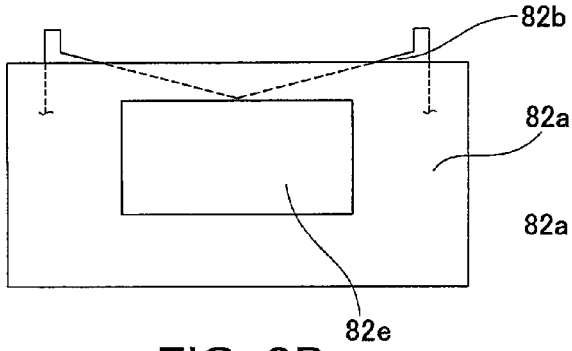
FIG. 2B is a front view of the movable cutter unit in the printer shown in FIG. 1.
Figure 2F:
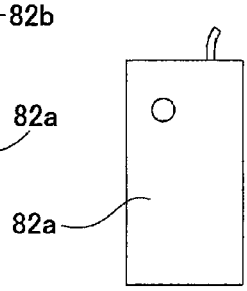
FIG. 2F is a right side view of the movable cutter unit in the printer shown in FIG. 1.
Figure 2C:
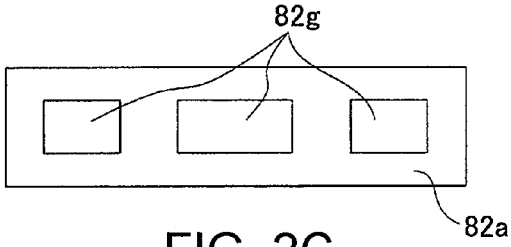
FIG. 2C is a bottom view of the movable cutter unit in the printer shown in FIG. 1.
Figure 2D:
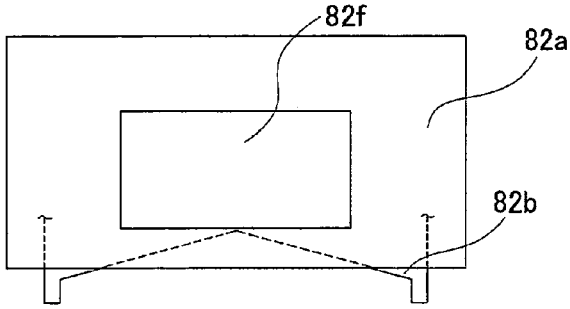
FIG. 2D is a back view of the movable cutter unit in the printer shown in FIG. 1.

Referring to FIG. 1, a printer according to an Example of the present invention includes: a lower frame 10 on which roll paper 500 is loaded; an upper frame 20 that openably covers the lower frame 10; a platen 30 mounted on the lower frame 10, which sends out the roll paper 500 toward a cutter section (will be described later); and a thermal type of print head 40 that carries out printing on a sheet of paper placed on a peripheral surface of the platen 30, for example.

The present printer further includes: a cutter section mounted above the lower frame 10 for cutting the roll paper 500 on which printing is made; an upper cover 70 detachably attached to a front of the upper frame 20; a lower cover 60 that allows a front of the lower frame 10 to be opened and closed, which is a single part made of a resin; and a control board 50 integrated into the lower frame 10 for controlling operations of the present printer.

The cutter section is constructed from a fixed blade 81 attached to the upper frame 20 and a movable cutter unit 82 attached to the lower frame 10 so as to face a lower portion of the fixed blade 81 through the roll paper 500 on which printing is made. The lower cover 60 covers at least a front surface of the movable cutter unit 82.

Referring to FIGS. 2A to 2F, the movable cutter unit 82 has a valley-shaped movable blade 82*b* connected to a drive mechanism (not shown in the drawings) and a casing 82*a* that receives the drive mechanism. The movable blade 82*b* is driven by the drive mechanism so as to perpendicularly go in and out from a top surface of the casing 82*a*. A hole portion 82*e* is formed on a front surface of the casing 82*a*, a hole portion 82*f* is formed on a back surface thereof, and three hole portions 82*g* are formed on a bottom surface thereof. Paper dust or a slip of paper generated by cutting roll paper 500 and entering the casing 82*a* is discharged from the hole portion to the outside of the casing 82*a*.

Referring again to FIG. 1, a slope portion 101 is provided at a portion of the lower frame 10 below the cutter section. The slope portion 101 causes the paper dust or the slip of paper arriving from the cutter section to slip down toward the front of the lower frame 10.

In the present printer, a pocket portion 61 is provided in the lower cover 60. In particular, the pocket portion 61 is adjacent to the lowest portion of the slope portion 101 to receive the paper dust or the slip of paper slipping down on the slope when the lower cover 60 is closed. The pocket portion 61 is integrally formed with the lower cover 60, and the lower cover 60 is a single part made of a resin.

In the present printer, there is no need for a user to collect paper dust or a slip of paper, set a small-sized dustpan or the like to the pocket portion 61 and sweep out with a small-sized broom or the like when the paper dust or the slip of paper is discarded, because the paper dust or the slip of paper slipping on the slope is received by the pocket portion 61. It is thus superior in operability and maintenance. Further, in the present printer, there is no worry about spillage that may occur when the paper dust or the slip of paper is swept out.

Moreover, a convex portion 65 is formed in the vicinity of a front surface of a lower end of the lower cover 60. On the other hand, a concave portion 103 is formed in the lower frame 10 so as to correspond to the convex portion 65. Thus, the lower cover 60 is rotatively opened in a direction (indicated by an allow A in FIG. 1) to which a rear end of the pocket portion 61 is lifted when the convex portion 65 is used as a fulcrum. Therefore, the paper dust or the slip of paper deposited in the pocket portion 61 does not fall when the lower cover 60 is opened. In this regard, with respect to a configuration for this fulcrum, a concave portion may be formed in the lower cover 60, while a convex portion may be formed in the lower frame 10. In this case, in the event that paper dust or a slip of paper is spilled from the pocket portion 61 when the lower cover 60 is opened, the paper dust or the slip of paper is not to be deposited because there is no concave portion in the lower frame 10 by forming the convex portion therein.

A pair of claw portions 66 (only one side is shown in the drawing) is also formed at the both sides of the lower cover 60 in a width direction (in FIG. 1, a direction perpendicular to a surface of the paper). On the other hand, a pair of concave portions 104 (only one side is shown in the drawing) is also formed at the both sides of the lower frame 10 in a width direction (in FIG. 1, a direction perpendicular to the surface of the paper) so as to correspond to the pair of claw portions 66. Then, when the lower cover 60 is closed using the convex portion 65 as a fulcrum, the pair of claw portions 66 is engaged with the pair of concave portions 104 of the lower frame 10, whereby the lower cover 60 is detachably fixed with respect to the lower frame 10.

Further, the lower frame 10 is provided with a portion 102 continuing over a front surface of the lower frame 10 from the slope portion 101. Thus, in the event that paper dust or a slip of paper is spilled from the pocket portion 61 when the lower cover 60 is opened, the paper dust or the slip of paper does not fall on the control board 50.

Moreover, in the present printer, a shielding member for preventing the paper dust or the slip of paper to be scattered toward a loaded portion of the roll paper 500 is provided between the slope portion 101 and the platen 30. In the present example, this shielding member is composed of an electricity removing brush 91 that removes static electricity charged on the platen 30 by sliding on a peripheral surface of the platen 30. Paper dust or a slip of paper generated by cutting the roll paper 500 may be scattered with great force from the top surface of the movable cutter unit 82 or each hole portion of the casing 82*a*. For this reason, it may be scattered toward the loaded portion of the roll paper 500 or the platen 30 from the top surface of the movable cutter unit 82 or the hole portion 82*f* and the like of the casing 82*a*. On the other hand, the shielding member of the present invention prevents the paper dust or the slip of paper to be scattered toward the loaded portion of the roll paper 500. Moreover, in the case where the shielding member is composed of the electricity removing brush 91, it removes the paper dust or the slip of paper attached to the peripheral surface of the platen 30, and prevents paper dust or a slip of paper to be attached to the peripheral surface of the platen 30 by canceling static electricity of the peripheral surface of the platen 30.

Further, in the present printer, a paper discharge path 62 that supports and discharges the roll paper 500 cut by the cutter section is provided on the lower cover 60. A drain portion 63 as a hole portion is formed in the paper discharge path 62. The drain portion 63 causes paper dust, a slip of paper and water arriving from the outside of the lower cover 60 to fall to the outside of the lower cover 60. On the other hand, a flap 92 that closes a paper discharge port 71 for protection against dust and water is provided in the vicinity of the paper discharge port 71 of the upper cover 70. The flap 92 is lightweight and is made of a material having flexibility, and thus, it allows discharge of the roll paper 500. The roll paper 500 that passes through the paper discharge path 62 and is discharged from the paper discharge port 71 is slightly pressed toward the paper discharge path 62 by the flap 92, whereby bending thereof is reformed.

Here, when the roll paper 500 is cut, paper dust or a slip of paper does not fall and may be attached to the roll paper 500 that has already been cut. Even if paper dust or a slip of paper is attached to a receipt or a ticket to be discharged from the paper discharge port 71, it does not cause a serious situation. However, in quality of a printed matter, it is preferable that paper dust or a slip of paper is not attached to the receipt or the ticket as much as possible. On the other hand, in the present printer, the roll paper 500 slides while the roll paper 500 is pressed to the paper discharge path 62 including the drain portion 63 by means of the flap 92. For this reason, the paper dust or the slip of paper attached to a back surface of the roll paper 500 is discharged from the drain portion 63 to the outside of the printer to an extent.

Further, in a printer used for a POS terminal, which is placed at an outdoor space such as a self-service filling station or placed in a store such as a restaurant and a supermarket for food, water may arrive at the inside of the paper discharge port. On the other hand, in the present printer, since water is discharged to the outside of the printer from the drain portion 63, water hardly enters the inside of the printer.

As described above, although the present invention has been described in view of the preferred example, the present invention is not limited to the embodiment described above. For example, the present invention can also be applied to a printer of a printing method other than a thermal printer, and a printer having an ink head, for example.

What is claimed is:

1. A printer, comprising:

a lower frame on which roll paper is loaded, a cutter section mounted above the lower frame for cutting the roll paper on which printing is made, a cover that allows a front of the lower frame to be opened and closed, and a slope portion for causing paper dust or a slip of paper to slip down toward the front of the lower frame, the slope portion being provided at a portion of the lower frame below the cutter section, the paper dust or the slip of paper falling from the cutter section, wherein the cover is provided with a pocket portion for receiving the paper dust or the slip of paper slipping down on the slope portion, and the pocket portion is adjacent to the lowest portion of the slope portion when the cover is closed, wherein the cover is provided with a paper discharge path that supports and discharges the roll paper cut by the cutter section, and a hole portion, formed in the cover, that causes the paper dust, the slip of paper and water arriving from an outside of the cover to fall to the outside of the cover is formed in the paper discharge path, wherein at least in an opened state that the cover is opened, the pocket portion is integrally formed with the cover and the pocket portion is not fixed to the lower frame, and wherein a convex portion is formed in the vicinity of a front surface of a lower end of the cover while a concave portion is formed in the lower frame so as to correspond to the convex portion so that the cover is rotatively opened in a direction to which a rear end of the pocket portion is lifted when the convex portion is used as a fulcrum.

2. The printer as claimed in claim 1, further comprising:

a platen for sending out the roll paper loaded on the lower frame toward the cutter section, and a shielding member for preventing the paper dust or the slip of paper to be scattered toward a loaded portion of the roll paper, the shielding member being located between the slope portion and the platen.

3. The printer as claimed in claim 2, wherein the shielding member is an electricity removing brush that removes static electricity charged on the platen by sliding on a peripheral surface of the platen.

4. The printer as claimed in claim 1, wherein the lower frame is provided with a portion continuing over a front surface of the lower frame from the slope portion.

5. The printer as claimed in claim 1, wherein the cover is a single part made of a resin.

6. The printer as claimed in claim 1, wherein the cutter section includes a fixed blade and a movable cutter unit disposed opposite to a lower side of the fixed blade, wherein the cover covers the movable cutter unit.

7. An electronic device comprising the printer as claimed in claim 1.

* * * * *